US006464012B1

(12) United States Patent
Strickland

(10) Patent No.: US 6,464,012 B1
(45) **Date of Patent: *Oct. 15, 2002**

(54) OIL LIFT SYSTEM

(75) Inventor: Charles Strickland, Hampton, AR (US)

(73) Assignee: Worth Camp, El Dorado, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/625,669

(22) Filed: Jul. 26, 2000

Related U.S. Application Data

(63) Continuation-in-part of application No. 09/207,883, filed on Dec. 8, 1998, which is a continuation-in-part of application No. 09/032,403, filed on Feb. 27, 1998, now Pat. No. 6,039,544.

(51) Int. Cl.[7] ..... E21B 43/00; F04B 23/00

(52) U.S. Cl. ..... 166/369; 294/68.22; 166/162; 417/53

(58) Field of Search ..... 166/250.15, 369, 166/370, 371, 372, 77.1, 90.1, 162, 168, 107; 294/68.22; 417/120, 53

(56) References Cited

U.S. PATENT DOCUMENTS

| | | | | |
|---|---|---|---|---|
| 3,617,152 A | | 11/1971 | Cummings | 417/54 |
| 4,086,035 A | | 4/1978 | Klaeger, Jr. et al. | 417/410 |
| 4,583,916 A | | 4/1986 | Senghass et al. | 417/36 |
| 5,911,278 A | | 6/1999 | Reitz | 166/372 |
| 6,039,544 A | * | 3/2000 | Strickland | 166/369 |

* cited by examiner

*Primary Examiner*—William Neuder
(74) *Attorney, Agent, or Firm*—Browning Bushman P.C.

(57) ABSTRACT

A wellhead assembly including a towable oil lift system, a drum, a wireline spooled on the drum, and a level wind mechanism is set forth to extend the wireline into and out of a well casing for production of a well. The wireline spools over a measuring wheel and extends into the well and supports a bailer on the end of the wireline. The bailer has a foot valve for filling, thereby enabling retrieval of a bailer into a surface located seal assembly connected with an air pump to force liquid from the bailer. A control system enables cyclic operation.

26 Claims, 4 Drawing Sheets

10
12
14
16
18
20
21
22
23
26
28
30
32
34
36
37
38
40
42
44
45
46
48
52
54
56
58
60
62
68
72
74
76
78

FIG. 4a
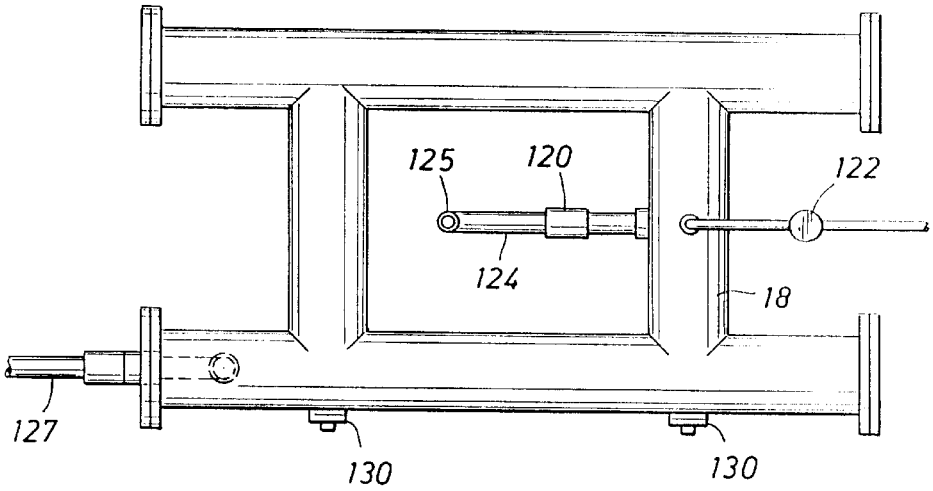
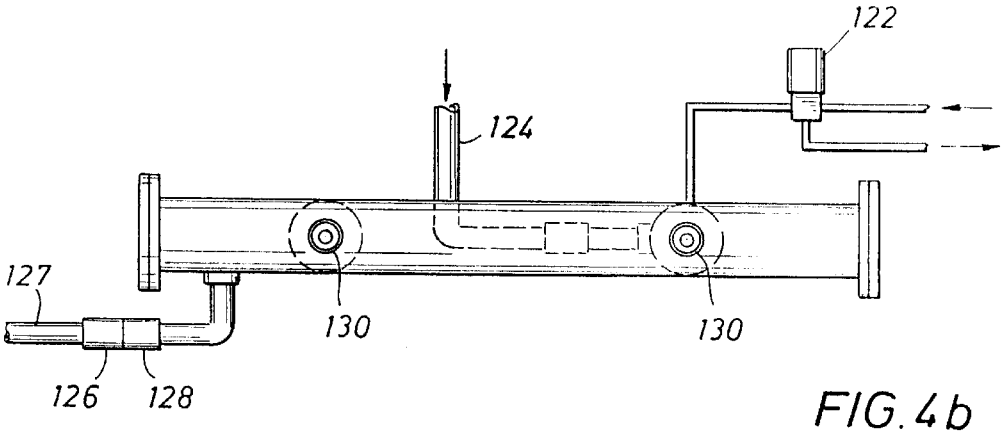
FIG. 4b
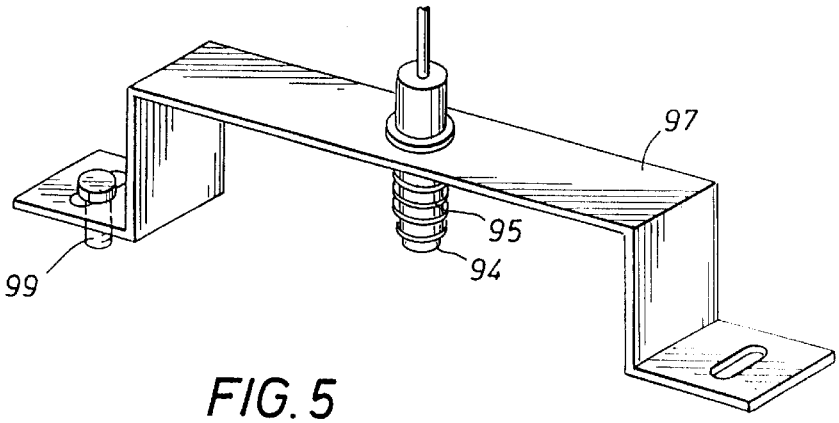
FIG. 5

OIL LIFT SYSTEM

This is a Continuation in Part of co-pending application Ser. No. 09/207,883, filed Dec. 8, 1998, which is a Continuation in Part of application Ser. No. 09/032,403 filed on Feb. 27, 1998, now U.S. Pat. No. 6,039,544.

FIELD OF THE INVENTION

The present invention relates generally to the field of oil field production systems and, more particularly, to a method and system for the economical production of oil from otherwise marginal wells.

BACKGROUND OF THE INVENTION

The present invention is directed to an economical oil lift system and method which reduce initial capital expenditure and operational costs in producing oil from stripper wells. Stripper wells typically produce up to about 10 barrels of oil per day. They may also produce water with the oil in various quantities. Stripper wells of that production volume are marginal economically and can be operated only if the capital and operational costs are reduced.

The present invention provides a method and apparatus for providing those kinds of reduced capital and operational costs. Stripper wells are normally straight and relatively shallow, requiring minimal but necessary installed equipment at significant cost. The typical method of producing a stripper well is to install a wellhead pump jack, a string of sucker rods, and a downhole pump. The wellhead equipment also normally entails a walking beam and electric motor at the surface. All this equipment has a well known cost.

Operational costs include the electricity required to power the pump, and periodic service of the wells. Servicing of a typical stripper well involves periodic removal of the sucker rod string, the tubing string and the downhole pump connected on the end of the sucker rod. Indeed, a workover rig is often required to service shallow wells with pump jack and sucker rods. Workover rigs of necessity involve a larger truck which has to be driven to the remote location of the wellhead, erected over the wellhead and then operated to pull all the tubular goods in the well. That preliminary step, even where the well is only 600 feet deep, takes three or more skilled personnel and requires at least an hour or two of operation ignoring the difficulties of getting the truck to the site and then onto the highway after the service job has been completed. Suffice it to say, the difficulties of servicing can range from relatively easy to tedious and difficult. These are activities and service charges which are avoided by the present oil lift apparatus.

The removal and reinstallation of these servicing components involves a substantial economic outlay. This service routine is typically undertaken to clean out the well when there is an excessive accumulation of sand around the pump or paraffin along the tubing. Sometimes, the sucker rods must be pulled to inspect them and to make appropriate replacements or to install rod guides or scrapers on the sucker rods. Sometimes, sucker rods will drag, thereby damaging the surface of the rod string, and possibly wearing against the adjacent tubular goods.

When all of these costs are taken into account, many wells have too little oil production to justify the expensive of the installation and maintenance of such equipment. Thus, there remains a need for a low cost system and method for production oil from strippers wells. The present invention is directed to such a system and method.

SUMMARY OF THE INVENTION

The present invention provides a small, portable oil lift system which may be temporarily installed at a wellhead, operated to produce a quantity of oil, and then moved to another wellhead, or operated as permanent equipment. Such a system eliminates the need to permanently install the expensive pump jack and associated equipment normally used in producing oil from a stripper well. Thus, many of the initial capital expenses for producing oil from a stripper well are significantly reduced.

Service for the present system is also distinctly better. A cased well is normally open from the wellhead down to the bottom of the well. The well in operation with the present invention remains open so that the service personnel can work on the well without the delay of having to pull sucker rods and tubing. Service is done through the wellhead without the preliminary step of installing a workover rig to pull sucker rods.

This disclosure sets out a wellhead system which is installed on a towable rig adjacent to the wellhead which utilizes no tubing or sucker rods. Instead of a sucker rod string operating a downhole reciprocating pump, it employs a drum which spools a lifting cable or wireline. The drum and wireline spooling apparatus and supportive frame are positioned adjacent to the wellhead. This equipment need not be moved at the time of servicing. Rather, the equipment inserted into the well comprises just a bailer and a long wireline. The cable or wireline is relatively small yet has sufficient diameter to support the weight which is carried on it (often, it is called a slick line). The produced oil (and any water which is found with it) is bailed out of the well by an elongate tubular bailer.

The present disclosure sets out an improved bailer where the liquid is removed from the bailer by positive air pressure which displaces the liquid. A 100' bailer is a preferable length, providing 0.5 barrel of fluid per cycle. With the bailer in excessive of about 30 feet, the liquid head becomes so great that vacuum removal, as disclosed in my U.S. Pat. No. 6,039,544, is not possible.

In the preferred embodiment of the invention, the bailer head is raised to a seal and the a bucket is then pressurized, thereby displacing the retrieved liquid out of the bailer and into a gathering system. When the bailer is in the up position at the top end of its cycle, it delivers the liquid, and is then free to either return down the well for another load of liquid, or be removed from the well so that the system may be transported to another wellhead for further production. Alternatively, the bailer may be left at the well head, and the remainder of the system transported to another wellhead, so that the time involved in setting up and breaking down the retrieval portion of the system is minimized.

For service work, the bailer is simply detached from the wireline, pulled from the wellhead, laid aside for the moment, and easy entry into the well is then obtained. Easy entry reduces the setup time to begin service. If the well is sanded up, it is easy to run a sand bailer or wash tubing into the well to dislodge and retrieve the accumulated sand, etc. At the completion of the service work, the sand removal equipment is simply pulled from the well and the bailer is reinserted into the well. Removal of equipment from the well and restoration of that equipment is done easily.

The present apparatus is summarized as equipment which is located at the surface. That equipment includes an elongate horizontal frame on a portable rig which is either rested on the ground or elevated. The portable rig supports a wireline winding mechanism adjacent to a wireline storage reel or drum. A level wind device is typically included. This provides a slick line which is extended from the storage reel or drum through the level winding device and then over a single measuring pulley. The pulley directs the wireline downwardly into the well borehole or casing. The equipment also includes certain load sensors which respond to the load on the slick line. The load on the line is measured dynamically so that the wireline load alters the motor operation so that the wireline is lowered from the surface, dropped into the liquid accumulated at variable depths in the borehole (casing), filled and then the wireline is retrieved with the filled bailer attached. The filled bailer is pulled to the surface. When the bailer arrives at the surface, a switch is triggered to stop further movement. In conjunction with that operation, the top of the bailer is sealed, and pressurized air then forces or displaces the liquid within the bailer out into an enclosure which encloses the system, before draining into the collection tank.

In addition, this disclosure sets forth an improved bailer construction which is much longer than 30 feet to enable delivery of a greater volume of oil. It is sufficiently long that physics requires removal by air displacement, and not by vacuum lift. A seal is provided which seals the bucket perfectly, thereby enabling air to be pumped into the bailer and force any liquid in the bailer from the bailer into an oil recovery system.

This invention may be operated in several, user-selectable modes. One may choose to operate the system in continuous mode, automatic timed-cycle mode, level control mode, or in manual mode. The system also provides an automatic restart capability, if the system is to be operated without any on-site supervision. In any of these modes, the system saves thousands of dollars per year in electrical cost, manpower, and servicing over previous systems employing a pump jack, sucker rods and pumps. The system offers the additional advantages in that it requires no site preparation, and it is completely mobile so that one unit can produce oil from multiple wells. These and other features and advantages of the invention will be apparent to those skilled in the art.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIGS. 4*a* and 4*b* are schematic diagrams of the collecting tank of the invention.

FIG. 5 is a detailed view of a support saddle for retaining a seal in accordance with this invention.

DETAILED DESCRIPTION OF A PREFERRED EMBODIMENT

Figure 1:
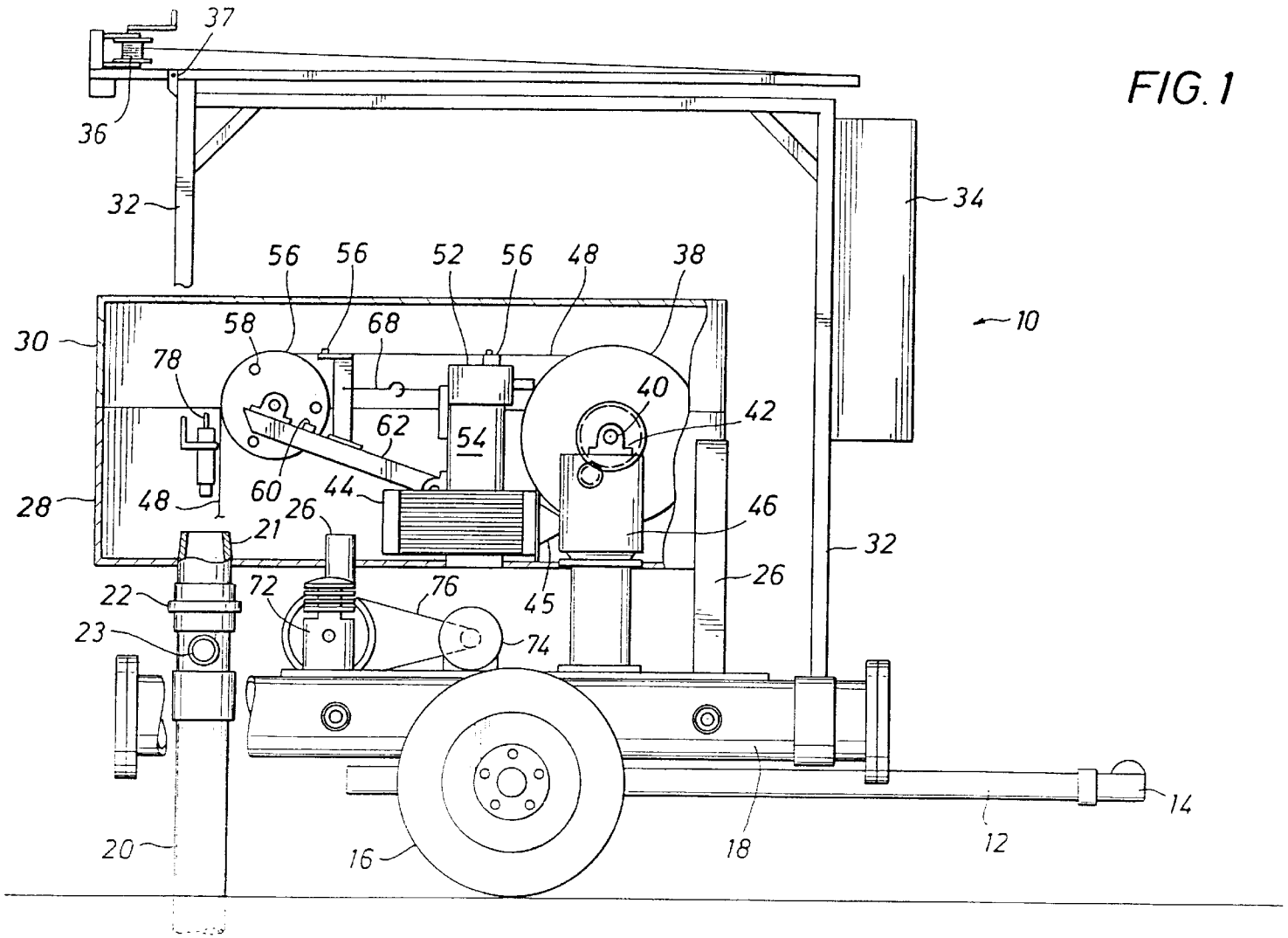
FIG. 1 is a side elevation view of the wellhead equipment of the present invention.

Attention is first directed to FIG. 1 of the drawings where the numeral 10 identifies the wellhead equipment of this invention which pumps produced oil and water from the well. The equipment is preferably mounted on a frame 12 which is adapted to be towed behind a standard vehicle such as a pickup by a tongue 14. The frame 12 supports all of the associated equipment and, in order to be fully functional, need only be plugged into an electrical outlet (not shown). The frame 12 is mounted to a set of wheels 16 to facilitate towing of the equipment.

Mounted directly to the frame 12 is a set of parallel, spaced-apart storage tanks 18. The tanks are shown in greater detail in FIGS. 4*a* and 4*b,* and described below. The spaced-apart orientation of the tanks facilitates positioning the equipment adjacent to and partially surrounding a well casing 20 at a wellhead. This orientation further provides mechanical space to mount the equipment to the frame 12 as well, for sturdiness of the structure.

Once the equipment is positioned at the wellhead, it is coupled to the casing 20 with a hammer union, merchant collar, or other connection 22. Between the connection 22 and the casing 20 is a bailer suspension orifice 23 for suspending the bailer in the well when removing the wellhead equipment 10. Also coupled to the casing 20 is a guide or mating collar 21, which is roughly of frustoconical configuration, to guide the bailer as it is drawn up to its home position.

Mounted to the frame 12 are a pair of vertical support members 26 to retain and support a closure 28 and a closure lid 30, which is attached to the closure 28 by any appropriate hinge members (not shown). The closure 28 and closure lid 30 enclose all of the mechanical and electro-mechanical equipment for running the bailer into and out of the casing 20. The closure 28 also serves as a sump reservoir to receive fluid evacuated from a bailer, as described below.

Also supported by the frame 12 is an external frame 32 which retains and supports an electronics/control enclosure 34 which holds the processor and monitoring gear for operating the wellhead equipment 10. The frame 32 also supports a bailer hoist 36 for manually running the bailer into position. The bailer hoist 36 is shown in FIG. 1 is the "stowed" or "traveling" position. When a bailer is to be made up and deployed into a well, the bailer hoist 36 is rotated about a pivot 37 to a vertical position, and a hoist cable 39 is then used to hold and control the bailer as it is made up and broken down.

Positioned within the enclosure 28 is a large wireline storage reel or drum 38. The drum 38 is supported on a centered shaft 40 which is rested on a pillow block 42 and is turned by a motor 44 through a gearbox 46. The motor 44 is preferably directly coupled to the gearbox 46 by way of a drive shaft 45. The shaft 40 supports the drum so that the drum is able to support a wireline or cable 48 having sufficient length to lower the bailer to the desired depth within the casing 20. The wireline 48 supports the bailer as it is lowered into and raised from the casing 20. The drum 38 is rotated clockwise and counter-clockwise by the electric motor 44 connected through the gearbox 46 in order to make repeated trips in the well to lift the produced oil and some water to the surface.

Figure 2:
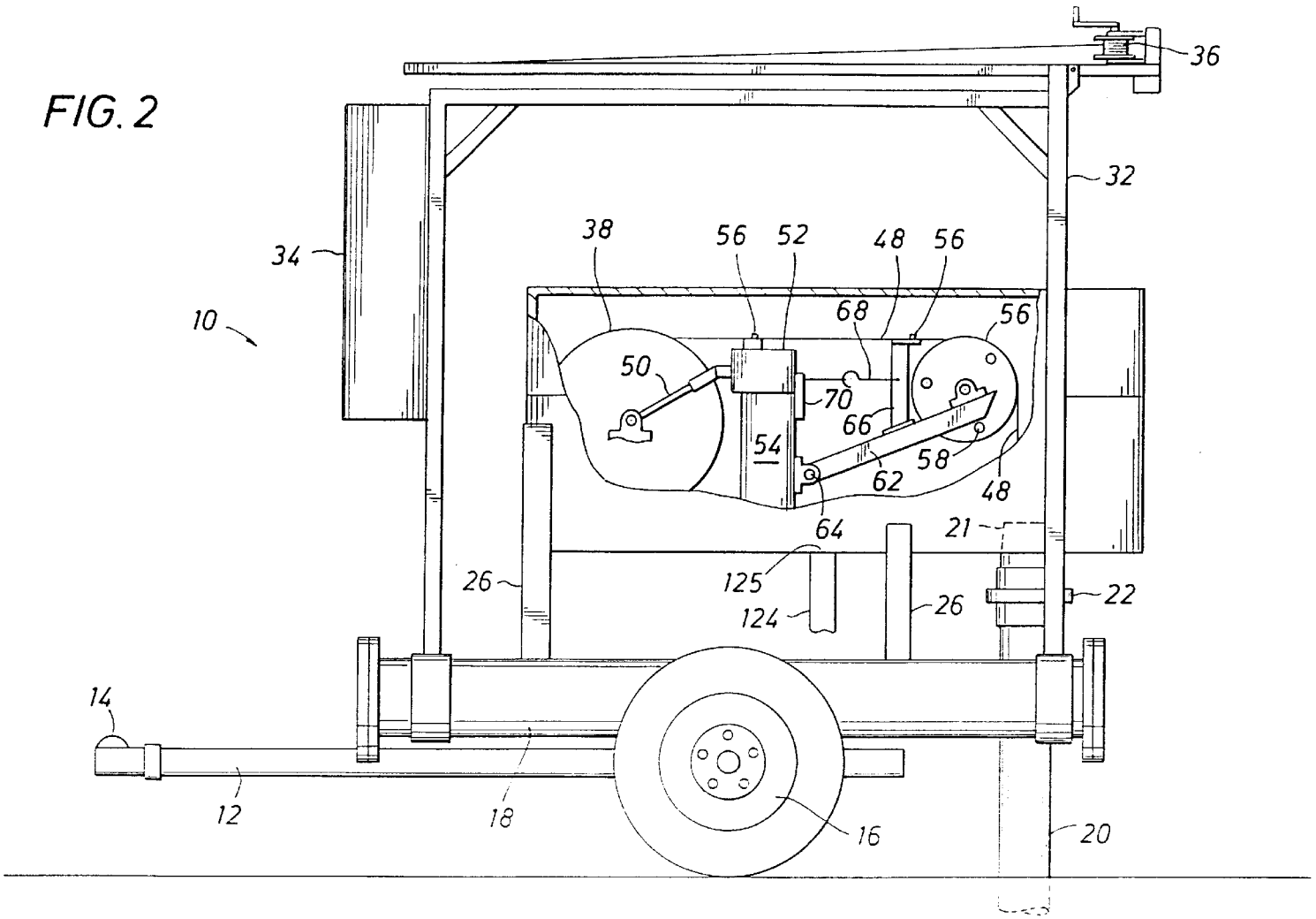
FIG. 2 is a side elevation showing the backside of the view of FIG. 1.

The drum 38 is rotated by the motor 44 through the drive shaft 45 and then to the gearbox 46. As shown in FIG. 2, the motor also drives a second and synchronized drive shaft 50 which connects with a level winding mechanism 52. The level winding mechanism 52 is mounted on a supporting frame member 54. It extends upwardly to position a wireline guide 56 engaging the wireline 48 so that the wireline is appropriately guided on and off the reel or drum 38. The level winding mechanism traverses back and forth across or in front of the drum 38. The drum 38 stores the wireline 48 on it in bights which are looped around the drum with a level accumulation. The wireline is stored on the drum layer by layer across the width of the drum. While each row is wound on the drum, the bights are placed side by side to smoothly accumulate the wireline. Among other things, this extends wireline life and reduces pinching of the wireline where it might be caught between bights and cut by later wraps of the wireline on the drum. The level winding mechanism is synchronized with operation of the drum in either direction (winding or unwinding wireline). The length of wireline extending horizontally is approximately eight feet between the drum 38 and a measuring wheel 56 so that the wireline guide reciprocates back and forth without undue loading laterally at the wireline guide.

The wireline extends to the right side of FIG. 1 and passes over the measuring wheel 56. The measuring wheel has a surrounding groove on it which guides the wireline 48 to turn downwardly into the casing 20. The measuring wheel has three holes 58 which are counted as each pass by, each count corresponding to a selected length measurement of wireline. The holes pass adjacent to a proximity detector 60. The detector 60 and the wheel 56 are mounted on a pair of pivoted support arms 62. Both arms 62 pivot at a common pivot point 64. The arms 62 rise and fall about the pivot 64. The measuring wheel 56 may be rotated out of the way of the casing 20 for ease of access during deployment of a bailer or for maintenance. However, the arms are supported at a specified location during production operations by a vertical member 66 and horizontal support link 68. The support link 68 is coupled to a strain gauge 70, which measures the tension in the support link 68. With no weight on the wireline 48, the strain gauge 70 provides a baseline reading (i.e., the empty weight of the bailer). When the weight of the bailer and enclosed liquid increases, the strain gauge provides a measure of that weight. Thus, the weight of oil lifted on the wireline 48 is directly measured by the strain gauge 70. By having a calibration value, the weight of lifted liquid is then indicated.

Also included within the enclosure 28 is an air compressor 72 which is driven by a motor 74 by way of a belt drive 76 in the conventional manner. The compressor 72 provides compressed air to an air supply line 78 to drive the fluid from the bailer when the bailer is returned to the surface. The air line between the compressor and the air supply line is omitted from FIG. 1 for clarity.

Figure 3A:
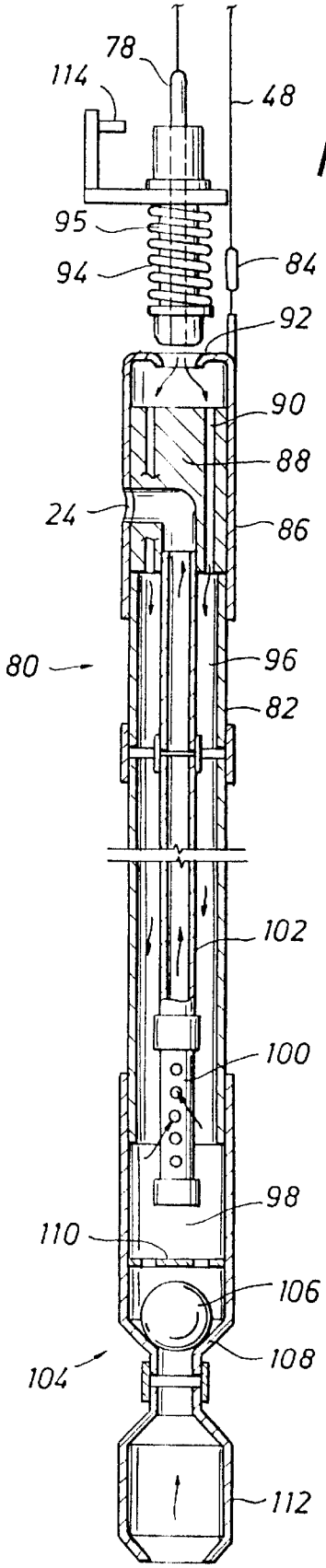
FIG. 3*a* is a sectional view showing bailer construction coupled to a wireline with the improved seal structure of the invention.

FIG. 3*a* shows a bailer 80 constructed in accordance with the invention. The bailer 80 describes roughly an elongate cylinder 82, sized to fit within industry standard casing 20. The bailer 80 is coupled to the wireline 48 with a swivel 84. The swivel is joined to a bailer head 86 which encloses an upper barrier 88, through which one or more air inlet orifices 90 are formed. The upper barrier 88 also includes the bailer discharge orifice 24 for discharge of fluids from the bailer. The top of the bailer head 86 forms a seal seat 92 which receives a spring loaded seal 94 when it is time to unload the bailer of fluids. The seal 94 is provided with a coil spring or other biasing means 95. Below the upper barrier 88 is an air inlet annulus 96 through which supplied air is carried downward. While air is forced downward under pressure, it displaces oil and water from the bailer which is carried to the surface. The flow path continues to a lower chamber 98 and into an axially oriented return fluid filter 100. From the filter 100, the flow path continues up an axially oriented central fluid line 102 and out the bailer discharge orifice 24 for the discharge of fluids from the bailer.

Referring briefly to FIG. 5, the seal 94 is preferably mounted to a support saddle 97 which is mounted athwartships in the enclosure 28. The saddle 97 is removably mounted with a set of bolts 99 or in any other appropriate manner so that the saddle 97 with seal installed can be quickly and easily removed and placed to the side for easy access to the wellhead.

It should be noted that the bailer discharge orifice serves an additional function. The bailer may be staged at the wellhead by lining up the orifice 24 with the suspension orifice 23 and placing a plug or nipple through the suspension orifice 23 into the bailer discharge orifice 24. In this way, the bailer can be left behind at a first well site, the equipment 10 towed to a second well site, and the equipment 10 made up to another bailer staged at the second well site, thereby eliminating significant preparation time and cost.

The bottom end of the bailer 80 includes a foot valve 104 which includes a ball 106, a seat 108, and a retention barrier 110. Below the foot valve 104 is a bailer guide and oil scoop 112 which receives oil when the bailer is lowered into a well. When the bailer is lowered into a well, the ball unseats and oil and water flow up into the bailer. When the bailer is full of fluid, the wireline is retracted, seating the ball against the seat and the bailer is pulled to the surface. When the bailer reaches the surface, the seat 92 forms a tight seal against the seal 94 and the spring is compressed. The presence of the bailer is detected by a bailer home position proximity detector 114. A solenoid valve 116 is then positioned to port compressed air through the supply line 78, forcing the retrieved fluid from the bailer as previously described. When all the fluid has been forced from the bailer, the valve 116 is positioned to a vent position to break the air lock in the bailer, and the bailer is now ready to be returned to the hole for more fluid.

Figure 3B:
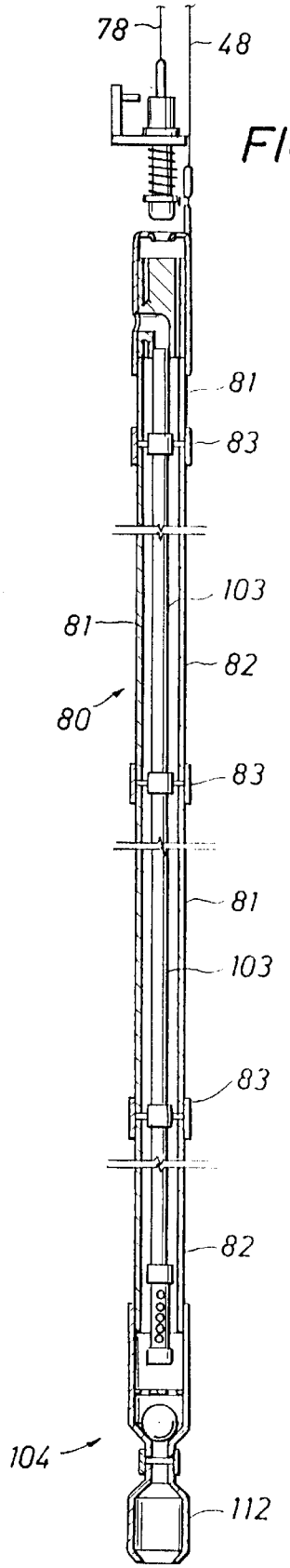
FIG. 3*b* is a section view showing a bailer formed of multiple modular lengths.

FIG. 3*b* shows another feature of the invention. The bailer may be made up of multiple lengths of sections, for example in 10' sections. The bailer is made up of one bailer head 86, one foot valve 104, and a plurality of intermediate sections 81. In a similar fashion, the return line 102 is made up of a plurality of sections 103. The sections 81 are joined together and to the bailer head and the foot valve with collars 83. The various sections can be stored and transported on top of the frame 32, hauled to a well site, and made up into a desired length of bailer.

The bailer is made up in sections to increase the volume or capacity of the bailer. While the system disclosed in my U.S. Pat. No. 6,039,544 has shown success, it is often economically necessary to make the bailer longer than 30 feet. The capacity or volume of the bailer is determined by is internal diameter and overall length. As a representative dimension, the bailer is preferably about 1 to 1½ inches smaller in diameter than the well casing. This enables easy travel of the bailer up and down the casing string. Because it is sized with some clearance with respect to the casing and has metal couplers every 10 feet, it is more or less centralized in the well so that the bailer is more or less aligned with the centerline axis of the casing.

Turning now to FIGS. 4*a* and 4*b*, when fluid is forced out of the bailer, it exits through the bailer discharge orifice 24, as previously described and flows into the enclosure 28. Then, by gravity drain, the fluid enters a fluid line 124 through a drain hole 125 and then by gravity flow into the collecting tank 18. The collecting tank comprises two spaced-apart tanks, with two communicating cross-tanks. When the tank 18 is fall, or there is no more fluid to flow into the tank, the equipment 10 is located near production facilities and stock storage tanks (not shown), and a flow line 127 having its own check valve 126 and ball valve 128 is connected to a separator and a stock storage tank. The solenoid valve 122 is then positioned to the "air" position, and the fluid is blown (i.e. displaced) out of the tank 18 to the production facilities. The tank is also provided with a plurality of clean-out accesses 130 which permit access for cleaning out the tank 18.

Routine Repetitive Operation

The wireline preferably has a length equal to the depth of the well plus added length to enable the wireline to be periodically inspected and the ends trimmed. In addition, the wireline has a diameter sufficient to raise the weight involved. That total weight on the wireline is the empty weight of the bailer, the weight of enclosed liquid (approximately 8 pounds per gallon), and the weight of the wireline itself. Wireline diameter is preferably sufficient to carry the above mentioned load plus a safety margin of perhaps an additional 1,000 pounds or so. A single strand slick line or woven wireline are both equally acceptable provided they have the capacity and length noted.

The operating cycle should be noted. Any well has a variable production rate. The production rate is adjusted so that the percolation rate of oil and water from the formation is steadily matched with the rate at which the lifted liquid is consistently removed. Each cycle of operation involves four time intervals in sequence which are (1) the time to lower the bailer from the surface to the head of oil or fluid; (2) the time for the bailer to fill; (3) the retrieval interval; and (4) the interval of time during which the fluid is forced from the bailer. Filling and draining typically occur in a span of just two to four minutes. Each cycle with the fluid level at about 1,000 feet should take between 20 to 30 minutes. Retrieval under load is typically slower than the speed of travel of an empty bailer. Accordingly, in a 1,000 foot well and using an average rate of 160 feet per minute, this involves a cycle of operation of about 6.5 minutes to lower the bailer, three or four minutes to fill the bailer, 10 minutes for retrieval and about 3 minutes for unloading the bailer. At that rate, the system can make about 48 to 72 trips per day and if the bailer length is 100', each trip retrieves 0.5 barrel of fluid for a daily production of between about 28 to about 42 barrels.

In a first embodiment, the wireline 48 has a diameter of 0.092 inches and the bailer has a capacity of 11 gallons, thereby representing a total bailer weight (when filled) of 175 pounds. In a second and presently preferred embodiment, the bailer is formed in sections of 10' each and can be any length up to the capacity of the equipment 10 to lift a full bailer, presently about 120' in length. With the bailer made up of 10' sections, the entire operation can easily be handled by one person. At the time of service, the preliminary step for executing service are simply removal of the bailer. It is set aside to clear the well casing to permit easy access to it. While the bailer is typically 100' or more in length, the 10' sections of the cylinder 82 and the return fluid line 102 enables easy handling by one service person. Accordingly, service of the present system is done more easily than heretofore. In fact, a workover rig is not needed for ordinary maintenance of the well.

Computer Control Aspects of the Invention

Now that the various mechanical aspects of the invention have been described in detail, the computer control aspects of the invention will now be illustrated. The equipment 10 includes the electronics and control enclosure 34, as previously described. Within the enclosure is a control processor, and all the various support electronics such as power supplies and metering devices. The control processor monitors a number of parameters throughout the equipment, and issues control commands to the various components under its control.

The following is a listing of pseudo-code which represents the presently preferred programming for the control processor. The listing is divided into the various control aspects, including automatic operation, level wind, manual operation, interlocks, and assorted subroutines.

Automatic Operation

```
Step 200 While Auto_Mode_Enable and Not Cycle_Stop
  and Not System_Interlock
Begin: (Automatic_Operation)

Step 202 If Auto_Mode_Enable and Not Home_Position
  Then
  Begin: (Find_Home)
    While Not Home_Position and Not Cycle_Stop and
      Not System_Interlock
    Raise_Bailer using Slow_Speed
  End: (Find_Home)
EndIf:

Step 204 If Auto_Mode_Enable and Home_Position Then
  Gosub: (Purge Bailer)
EndIf:
Step 206 If Bailer_Purge_Timer Done And Not Cycle_
  Stop and Not System_Interlock Then
  Gosub: (Top_Delay)
EndIf:

Step 208 If Top_Cycle_Delay_Timer Done and Not
  Cycle_Stop and Not System_Interlock and Not Learn_
  Cycle and Not Auto_Cycle Then
  Begin: (Influid_Detect)
    While Not Learn_Cycle
    Lower Bailer using Slow_Speed
    If Bailer_Depth=2 Then
    Store Empty_Bailer_Weight
    EndIf:
    If Bailer_Depth>=3 and <=5 Then
      Accelerate Bailer Speed to Influid_Detect_Speed
    EndIf:
Step 210 If Bailer_Weight 21 (Empty_Bailer_Weight-
  Influid Detect Weight) and Bailer_Depth=5 Then
  Start Fluid_Transfer_Timer
  Begin: (Influid_Startup)
    If Bailer_Depth<(Bailer_Length+5) and Bailer_
      Weight>Slack_Weight Then
    Lower Bailer using Medium_Speed
    EndIf:
    Gosub: (Bottom_Delay)
    If Bottom_Cycle_Delay_Timer Done and Bailer_
      Depth>20 and Drum_Rotation_Counter>40 Then
    Raise Bailer using Fast_Up_Speed
    EndIf
    If Bottom_Cycle_Delay_Timer Done and (Bailer_
      Depth<20 or
    Drum_Rotation_Counter<40) and Not Home_
      Position Then
    Raise Bailer using Slow_Speed
    EndIf:
  End: (Influid_Startup)
Else Set Learn_Cycle
  EndIf:
    EndWhile:
```

```
    End: (Influid_Detect)
EndIf:

Step 212 If Learn_Cycle and Not Cycle_Stop and Not
  System_Interlock Then
    Begin: (Fluid_Detect)
      While Bailer_Weight>(Bailer_Empty_Weight-
        (Bailer_Empty_Weight x .1)
      Lower Bailer using Medium_Speed
      EndWhile:
    End: (Fluid_Detect)
      Set Last_Fluid_Level equal to Bailer_Depth
      Set Bailer_Speed equal to Slow_Speed
      Start Fluid_Transfer_Timer
    While Bailer_Depth<(Last_Fluid_Level+Bailer_
      Length) Then
      Gosub: (Entering_Fluid)
    EndWhile:
If Bailer_Depth>=(Last_Fluid_Level+Bailer_Length)
  Then
    Gosub: (Bottom_Delay)
EndIf:
Step 214 While Bailer_Depth>20 and Drum_Rotation_
  Counter>40 and Not Cycle_Stop and Not System_
  Interlock Then
    Raise Bailer using Fast_Up_Speed
EndWhile:

Step 216 While Not Home_Position and Not Cycle_Stop
  and Not System_Interlock and (Bailer_Depth<20 or
  Drum_Rotation_Counter<40) Then
    Raise Bailer using Slow_Speed
EndWhile:
EndIf:
Gosub: (Purge_Bailer)
Gosub: (Top_Cycle_Delay)

Set Auto_Cycle

Step 218 While Auto_Cycle and Not Cycle_Stop and Not
  System_Interlock Then
    Begin: (Bailer_Down_Fast)
      While Bailer_Depth<Last_Fluid_Level-30
      Lower Bailer using Fast_Down_Speed
      EndWhile:
    End: (Bailer_Down_Fast)
    Begin: (Fluid_Detect)
      While Bailer_Weight>(Bailer_Empty_Weight-
        (Bailer_Empty_Weight x .1)) or
      Bailer_Depth<Level_Control_Setpoint
      Lower Bailer using Medium_Speed
      EndWhile:
    End: (Fluid_Detect)
    If Bailer_Weight>(Bailer_Empty_Weight-Bailer_
      Empty_Weight x .1)) Then
    Begin: (Fluid_Detected)
      Set Fluid_Detected
      Set Last_Fluid_Level equal to Bailer_Depth
      Set Bailer_Speed equal to Slow_Speed
      Start Fluid_Transfer_Timer
    End: (Fluid_Detected)
    EndIf:
    While Fluid_Detected and Bailer_Depth<(Last_Fluid_
      Level+Bailer_Length) Then
      GoSub: (Entering_Fluid)
    EndWhile:
If Bailer_Depth>=(Last_Fluid_Level+Bailer_Length)
  Then
    GoSub: (Bottom_Delay)
EndIf:
Step 220 While Bailer_Depth>20 and Drum_Rotation_
  Counter>40 and Not Cycle_Stop and
Not System_Interlock Then
    Raise Bailer using Fast_Up_Speed
EndWhile:

Step 222 While Not Home_Position and Not Cycle_Stop
  and Not System_Interlock and (Bailer_Depth<20 or
  Drum_Rotation_Counter<40) Then
    Raise Bailer using Slow_Speed
EndWhile:
GoSub: (Purge_Bailer)
GoSub: (Top_Cycle_Delay)
EndWhile:

While Fluid_Transfer_Timer Not Done
    Open Fluid_Transfer_Solenoid_Valve
    Start Air_Compressor
EndWhile:

Step 224 If Lowering_Bailer Then
    Begin: (Depth_Counter_Increment)
      If Footage_Counter_Prox_Switch is On Then
        Increment Footage_Counter
      EndIf:
      If Drum_Rotation_Prox_Switch is On Then
        Increment Drum_Rotation_Counter
      EndIf:
    End: (Depth_Counter_Increment)
EndIf:

Step 226 If Raising_Bailer Then
    Begin: (Depth_Counter_Decrement)
      If Footage_Counter_Prox_Switch is On Then
        Decrement Footage_Counter
      EndIf:
      If Drum_Rotation_Prox_Switch is On Then
        Decrement Drum_Rotation_Counter
      EndIf:
    End: (Depth_Counter_Decrement)
EndIf:

Set Slack_Setpoint=Zero_Cal_Weight+Slack_Offset
Set Slack_Hysteresis_Setpoint=Zero_Cal_Weight+
  Slack_Hysteresis_Offset
End: (Automatic_Operation)
EndWhile:

Level Wind

Step 228 If PV_Right_to_Left Then
    Set Level_Wind_Right_to_Left
EndIf:
If PV_Left_to_Right Then
    Set Level_Wind_Left_to_Right
EndIf:
Step 230 If (Raising_Bailer and Level_Wind_Right_
  Limit_Switch is On) or (Lowering_Bailer and Level_
  Wind_Left_Limit_Switch is On) Then
```

Begin: (Actuator_Extend)
Set Level_Wind_Actuator_Extend
Reset Level_Wind_Actuator_Retract
End: (Actuator_Extend)
EndIf:

Step 232 If (Raising_Bailer and Level_Wind_Left_Limit_Switch is On) or (Lowering_Bailer and Level_Wind_Right_Limit_Switch is On) Then
Begin: (Actuator_Retract)
Set Level_Wind_Actuator_Retract
Reset Level_Wind_Actuator_Extend
End: (Actuator_Retract)
EndIf:

Step 234 If Level_Wind_Actuator_Retract or (Level_Wind_Right_to_Left and Raising_Bailer) or (Level_Wing_Left_to_Right and Lowering_Bailer) Then
Start Level_Wind_Retract_Timer
EndIf:
Step 236 If Level_Wind_Retract_Timer Timing Then
Set Retract_Relay_Output
EndIf:

Step 238 If Level_Wind_Actuator_Extend or (Level_Wind_Right_to_Left and Lowering_Bailer) or (Level_Wind_Left_to_Right and Raising_Bailer) Then
Start Level_Wind_Extend_Timer
EndIf:
Step 240 If Level_Wind_Extend_Timer Timing Then
Set Extend_Relay_Output
EndIf:
Step 242 If PV_Left_to_Right or Level_Wind_Retract_Timer Done or
Level_Wind_Extend_Timer Done Then Reset Level_Wind_Right_to_Left
EndIf:

Step 244 If PV_Right_to_Left or Level_Wind_Retract_Timer Done or Level_Wind_Extend_Timer Done Then Reset Level_Wind_Left_to_Right
EndIf:

Step 246 If Level_Wind_Right_Limit_Switch or Level_Wind_Left_Limit_Switch Then
Clear Level_Wind_Span_Counter
EndIf:

Step 248 If Level_Wind_Left_Limit_Switch or Level_Wind_Right_Limit_Switch or
(Raising_Bailer and Level_Wind_Bailer_Down and Not Level_Wind_Count_Up) or
(Lowering_Bailer and Level_Wind_Bailer_Up and Not Level_Wind_Count_Up) Then
Set Level_Wind_Count_Up
EndIf:

Step 250 If Raising_Bailer and Level_Wind_Bucket_Down and Level_Wind_Count_Up Then
Begin: (Level_Wind_Bailer_Up)
Reset Level_Wind_Count_Up
Reset Level_Wind_Bailer_Down
Set Level_Wind_Bailer_Up
End: (Level_Wind_Bailer_Up
EndIf:

Step 252 If Lowering_Bailer and Level_Wind_Bailer_Up and Level_Wind_Count_Up Then
Begin: (Level_Wind_Bailer_Down)
Reset Level_Wind_Count_Up
Reset Level_Wind_Bailer_Up
Set Level_Wind_Bailer_Down
End: (Level_Wind_Bailer_Down)
EndIf:

Step 254 If Level_Wind_Right_to_Left or Level_Wind_Left_to_Right Then
Set Level_Wind_Span_Counter_Disable
EndIf:

Step 256 If Level_Wind_Right_Limit_Switch or Level_Wind_Left_Limit_Switch Then
Reset Level_Wind_Span_Counter_Disable
EndIf:
Step 258 If Not Level_Wind_Right_Limit_Switch and Not Level_Wind_Left_Limit_Switch
Then
Clear Level_Wind_Shift_Counter
EndIf:

Manual Operation
Step 260 While Not Auto_Mode_Enable and Not System_Interlock
Begin: (Manual_Mode)
If Not Home_Position and PV_Zero_Cal Then
Set Zero_Cal_Weight=Bailer_Weight
EndIf:
If PV_Load_Wire Then
Bailer_Depth=0
EndIf:

Step 262
If PV_Bailer_Purge and Home_Position Then
Begin: (Manual_Bailer_Purge)
Open Bailer_Purge_Solenoid_Valve
Start Air_Compressor
End: (Manual_Bailer_Purge)
EndIf:

Step 264
If PV_Fluid_Transfer Then
Begin: (Manual_Fluid_Transfer)
Open Fluid_Transfer_Solenoid_Valve
Start Air_Compressor
End: (Manual_Fluid_Transfer)
EndIf:

Step 266
If Manual_Bailer_Speed=Slow and PV_Increase_Speed Then
Set Manual_Bailer_Speed=Medium_Speed
EndIf:
If Manual_Bailer_Speed=Medium_Speed and PV_Increase Speed Then
Set Manual_Bailer_Speed=Fast_Up_Speed
EndIf:

If Manual_Bailer_Speed=Fast_Up_Speed and PV_Decrease_Speed Then

Set Manual_Bailer_Speed=Medium_Speed
EndIf:

Step 268
If (Manual_Bailer_Speed=Medium_Speed and PV_Decrease_Speed) or
Bailer_Depth<20 or Drum_Rotation_Counter<40 Then Set Manual_Bailer_Speed=Slow_Speed
EndIf:

Step 270
If PV_Jog_Up and not PV_Jog_Stop and Not Home_Position and Not System_Interlock
Then Raise Bailer using Manual_Bailer_Speed
EndIf:
If PV_Jog_Down and Not Pv_Jog_Stop and Not System_Interlock
Then Lower Bailer using Manual_Bailer_Speed
EndIf:

Step 272
If PV_Auto_Restart and First_Pass Then
Start Auto_Restart_Timer
EndIf:
If Cycle_Start or Auto_Restart_Timer Done and Not System_Interlock Then
Set Auto_Mode_Enable
EndIf:
End: (Manual_Mode)
EndWhile:

Interlocks
Step 274 If (Lowering_Bailer and Bailer_Depth=5 and Bailer Weight>Bailer_Purge Weight) or Drive_Fault or (Bailer_Weight>Overtension_Weight and Not Home_Position) or Bailer_Motion_Fault or (Bailer_Weight<Slack_Setpoint and Raising_Bailer) or Level_Wind_Overtravel or Not Input_Device_Power_Confirmation Then
Set System_Interlock
EndIf:

Step 276 If PV_System_Reset and Not ((Lowering_Bailer and Bailer_Depth=5 and Bailer Weight>Bailer_Purge Weight) or Drive_Fault or (Bailer_Weight>Overtension_Weight and Not Home_Position) or Bailer_Motion_Fault or (Bailer_Weight<Slack_Setpoint and Raising_Bailer) or Level_Wind_Overtravel or Not Input_Device_Power_Confirmation) Then
Reset System_Interlock
EndIf:

Step 278 If Lowering_Bailer or Raising_Bailer and Footage_Counter_Prox_Switch is On Then
Start Footage_Counter_Stuck_On_Timer
EndIf:
If Lowering_Bailer or Raising_Bailer and Footage_Counter_Prox_Switch is Off Then
Start Footage_Counter_Stuck_Off_Timer
EndIf:
If Footage_Counter_Stuck_On_Timer Done or Footage_Counter_Stuck_Off_Timer Done Then
Set Bailer_Motion_Fault
EndIf:

If Drum_Rotation_Prox_Switch and Level_Wind_Count_Up and Not Level_Wind_Span_Counter_Disable Then
Increment Level_Wind_Span_Counter
EndIf:
If Drum_Rotation_Prox_Switch and Not Level_Wind_Count_Up and Not Level_Wind_Span_Counter_Disable Then
Decrement Level_Wind_Span_Counter
EndIf:

If Level_Wind_Right_Limit_Switch or Level_Wind_Left_Limit_Switch and Drum_Rotation_Prox_Switch Then
Increment Level_Wind_Shift_Counter
EndIf:

If Level_Wind_Span_Counter>Level_Wind_Max_Count or Level_Wind_Span_Counter<Level_Wind_Min_Count or Level_Wind_Shift_Count>=20 Then
Set Level_Wind_Overtravel
EndIf:

Sub-Routines
Step 280 Begin: (Purge_Bailer)
While Not Cycle_Stop and Not System_Interlock and Bailer_Purge_Timer Not Done
Open Bailer_Purge_Solenoid_Valve
Start Air Compressor
Start Bailer_Purge_Timer
EndWhile:
End: (Purge Bailer)

Step 282 Begin: (Bottom_Cycle_Delay)
Start Bottom_Cycle_Delay_Timer
While Bottom_Cycle_Delay_Timer Not Done
Delay
EndWhile:
End: (Bottom_Cycle_Delay)

Step 284 Begin: (Top_Cycle_Delay)
Start Top_Cycle_Delay Timer
While Top_Cycle_Delay_Timer Not Done
Delay
EndWhile:
End: (Top_Cycle_Delay)

Step 286 Begin: (Entering_Fluid)
While Fluid_Transfer_Timer Not Done
Open Fluid_Transfer_Solenoid_Valve
Start Air_Compressor
EndWhile:
If Bailer_Weight>Slack_Hysteresis_Weight and Bailer_Speed<Maximum_Influid_Speed Then
Bailer_Speed=(Bailer_Speed+50)
EndIf:
If Bailer_Weight<Slack_Hysteresis_Weight and Bailer_Speed>Slow_Speed Then
Bailer_Speed=(Bailer_Speed-50)

EndIf:

If Bailer_Weight<Slack_Weight Then

Bailer_Speed=0

EndIf:

End: (Entering_Fluid)

Automatic operation of the system of this invention begins with step 200, wherein the system verifies that the system is set for automatic operation and the processor does not include any signals which would stop operations. In step 202, the processor senses if the bailer is in the "home" or full up position with the bailer sealed against the seal, and if it is not, the processor directs the motor 44 to begin raising the bailer at a slow speed. In step 204, if the processor senses that the bailer is in the home position by means of the home position proximity detector 114, then the subroutine of step 280 is initiated to purge the bailer.

In step 206, the processor determines if the timer which times the purge of the bailer has timed out, then initiates a timed delay with the bailer in the home position. Once that's done, step 208 the processor determines if conditions are met to send the bailer back down the hole for another load of fluid. The system is provided with the feature of detecting and storing the level of fluid in the hole so that on subsequent trips down the hole, the bailer can be lowered at a higher speed to cut down on transit time and therefore cycle time. All the depth calculations and determinations made by the system are relative to the bailer at the home position, and thus the operator must know how many sections have bailer have been made up to input into the processor the total length of the bailer.

In step 208, as the bailer is lowered at slow speed near the top of the hole, the processor determines and stores the empty bailer weight as determined by the baseline reading on the gauge 70. This measurement is taken when the head of the bailer is about 2 feet below home position. The bailer is then accelerated to another speed, called the influid detect speed. This is takes place from about 3 feet to about 5 feet. This technique is used to determine if the first cycle starts out with the bailer already in fluid, such as in a flooded well.

In step 210, the system uses more of the intelligence of the processor while the bailer is down the hole. The system determines if the weight detected by the gauge 70 indicates that the bailer has started out in fluid, then the bailer is lowered at a medium speed for a period of time sufficient to lower the bailer by one bailer length. Once the bailer has been lowered for a predetermined time, then the bailer is raised at high speed. However, on the way up, the system slows the bailer to slow speed once it nears the top of the hole, so that the bailer eases into sealing engagement with the seal.

Step 212 is yet another feature of the present invention. The processor is provided with the capability to learn the fluid level in the hole and use that fluid level to control bailer speed to cut transit time. Once the processor learns the last known fluid level, and knowing the length of the bailer, then the processor goes to the subroutine of step 284 as the fluid enters the bailer. In step 214, if the bailer is being raised and as long as it is below a predetermined depth, such as 20 feet, and the drum rotation counter is greater than some predetermined count, such as 40 counts (which translates to approximately 20 feet), then the bailer is raised at high speed. But once the bailer reaches either of these predetermined limits, the system slows bailer speed to slow speed in step 216.

Similarly, in Step 218, once the system knows the fluid depth in the hole, then the bailer is lowered at high speed to the depth related to the last known fluid level. Step 218 also includes a safety feature in that the bailer is lowered at medium speed while the bailer weight is greater than 90% of empty weight or bailer depth is less than a level control setpoint. Once the bottom of the bailer hits fluid in the well, then the wireline will go slack and drop below 90% of the bailer empty weight. If bailer depth is determined to be greater than or equal to the last known fluid level plus the length of the bailer, then the bottom delay subroutine of step 282 is initiated. This feature of the invention may be used to operate the system in level control mode. I have found that an efficient way to produce oil from a well is to produce oil from the well while maintaining a relatively constant level within the well. In this mode, if the bailer reaches the level setpoint and does not detect fluid, then the bailer stops at this level.

In steps 220 and 222, as before, the controller raises the bailer at fast speed until it is close to the top of the hole, then slows the bailer to slow speed. The system then forces the fluid from the bailer under air pressure in the subroutine of step 280, and begins the top cycle delay of step 284.

Step 224 provides the processor with the capability of tracking the position of the bailer during lowering operations, and step 226 provides this capability while raising the bailer.

Steps 228 through 258 inclusive describe the control aspects for operation of the level wind feature of the invention. The controls are necessary to carefully coordinate the winding and unwinding the wireline from the wheel so that the wireline is laid neatly side-by-side with previous bytes of the wireline.

Steps 260 to 272 show the various controls by the processor when the system is set for manual operation. Even in manual mode, the processor monitors various parameters of the system for safe operation. The manual mode, in particular, includes the capability to purge the bailer by manual operation of the valve 116 in step 262, but only if the bailer is in the home position. Similarly, step 264 provides the capability for manual transfer of the fluid from the tank 18 to the more permanent storage facility. Steps 266 and 268 provide for safe yet expeditious bailer speed.

Steps 274 through 278 provide the various interlocks of the system. These steps detect various faults in the system to prevent equipment damage. Finally, steps 280 to 284 show the various subroutines for fluid transfer and delay for the bailer operation.

While the foregoing is directed to the preferred embodiment, the scope is determined by the claims which follow.

I claim:

1. A method of producing oil from a well comprising the steps of:

a. lowering a bailer into a well on a wireline;

b. filling the bailer with produced well liquids;

c. retrieving the bailer to the wellhead to a position near the wellhead;

d. sealing the top of the bailer against a seal;

e. pressurizing the bailer to force produced well liquids from the bailer; and f. lowering the bailer into the well for subsequent retrieval of additional well liquids.

2. The method of claim 1 wherein the speed of lowering and retrieving the bailer is determined under processor control.

3. The method of claim 1, further comprising the steps of:

g. noting the level at which the bailer is filled in step a.; and h. controlling the speed at which the bailer is lowered in step f.

4. The method of claim 1, further comprising the steps of:

g. retrieving the bailer in step c. until the bailer reaches a predetermined distance below the wellhead; and h. then retrieving the bailer at a slower speed to a position near the wellhead.

5. The method of claim 1 wherein the step of pressurizing the bailer is controlled by a processor in response to a signal from a proximity switch which indicates that the top of the bailer is sealed against a seal.

6. The method of claim 5 further comprising the step of filling the bailer through a foot valve.

7. The method of claim 1, further comprising the step of determining the liquid level in the well at which the bailer is filled with produced well fluids.

8. The method of claim 1 further comprising the step of varying the speed at which the bailer is lowered or retrieved based on the depth of the bailer in the well.

9. The method of claim 1 wherein the step of pressurizing the bailer to force produced well liquids from the bailer transfers the well liquids into a receiving tank.

10. The method of claim 1 wherein the step of pressurizing the bailer to force produced well liquids from the bailer is performed under the control of a processor.

11. The method of claim 1 repeating steps 1(*b*) through 1(*f*) until the volume of well liquids recovered indicates that further recovery is no longer effective.

12. The method of claim 1, wherein oil is produced from the well only above a predetermined level within the well.

13. An oil lift system for producing oil from a well, the system comprising:

a. a support adjacent to a wellhead;

b. a wireline;

b. a drum for storing the wireline to alternately retrieve and extend the wireline therefrom, wherein the wireline extends into the well borehole;

c. a bailer attached to the end of the wireline;

d. a seal to seal the bailer to permit pressurization of the bailer in order to force fluids from the bailer; and e. a control system for responsively lowering and raising the bailer to thereby remove produced liquids from the well in the bailer and to return the bailer in the well borehole for cyclic operation.

14. The system of claim 13, further comprising a level wind system to control the placement of the wireline on the drum in side-by-side rows.

15. The system of claim 13 further comprising an air compressor to pressurize the bailer.

16. The system of claim 13, further comprising wheels coupled to the support and wherein the system is adapted to be towed behind a vehicle.

17. The system of claim 13, further comprising a proximity switch to indicate that the bailer is sealed.

18. The system of claim 13, wherein the bailer comprises:

a. an elongate cylinder with a top end and a bottom end;

b. a bailer head at the top end, the bailer head having an upper barrier with at least one air flow orifice and at least one fluid flow orifice therethrough;

c. a fluid tube coupled to the fluid flow orifice;

d. an annulus around the fluid tube with fluid communication through at least one air flow orifice into the fluid tube; and e. a foot valve at the bottom end of the bailer.

19. The system of claim 18, wherein the bailer head further comprises a seated orifice adapted for mating engagement with the seal.

20. The system of claim 19, wherein the seal including a spring to force the seal against the seat.

21. The system of claim 18, further comprising a filter on the fluid tube.

22. The system of claim 13, further comprising a receiving tank to receive fluids forced from the bailer.

23. The system of claim 13, further comprising a motor coupled to the drum to drive the drum for alternately retrieving and extending the wireline.

24. The system of claim 23, further comprising a drive shaft coupling the motor to the drum.

25. The system of claim 13, further comprising a swivel attaching the bailer to the wireline.

26. The system of claim 13, wherein the bailer is formed of detachable sections.

* * * * *